United States Patent [19]

Viemon

[11] 4,432,717

[45] Feb. 21, 1984

[54] APPARATUS FOR FILLING MOLDS CARRIED ON A CONVEYOR BELT

[75] Inventor: Bernard Viemon, Trelaze, France

[73] Assignee: SAFAMA S. A., Angers, France

[21] Appl. No.: 346,156

[22] Filed: Feb. 5, 1982

[30] Foreign Application Priority Data

Apr. 11, 1981 [FR] France ..... 81 20657

[51] Int. Cl.[3] ..... B28B 1/08

[52] U.S. Cl. ..... 425/429; 264/70; 425/220; 425/430

[58] Field of Search ..... 425/134, 220, 432, 434, 425/426, 429, 430; 264/70, 71

[56] References Cited

U.S. PATENT DOCUMENTS

| | | | |
|---|---|---|---|
| 1,149,747 | 8/1915 | Flack | 425/220 |
| 1,284,670 | 11/1918 | Haws | 425/220 |
| 1,366,226 | 1/1921 | Welsh | 425/134 |
| 1,453,747 | 5/1923 | Carey | 425/220 |
| 1,568,832 | 1/1926 | Harrison | 425/432 |
| 1,905,975 | 4/1933 | Thomas | 425/432 X |

*Primary Examiner*—Jay H. Woo
*Assistant Examiner*—James C. Housel
*Attorney, Agent, or Firm*—Charles E. Brown

[57] ABSTRACT

Apparatus for filling flat molds for slabs and the like carried on a conveyor belt is disclosed. The molds are displaced by the conveyor belt from a filling unit to a finishing unit. The filling unit comprises a vibrating table imparting vertical vibrations to the mold and a distributor member extends transversely of the conveyor for spreading the molding material supplied immediately ahead of the distributor member in the mold at the filling station. Horizontal vibrations are imparted to the distributor member parallel to the path of movement of the conveyor belt. The finishing unit has a smoothing member to which horizontal vibrations are imparted. The smoothing member is reciprocated transversely of the path of movement of the conveyor belt.

14 Claims, 5 Drawing Figures

APPARATUS FOR FILLING MOLDS CARRIED ON A CONVEYOR BELT

BACKGROUND OF THE INVENTION

The present invention relates to installations for the continuous manufacture of slabs obtained by molding a settable molding material. More particularly, it is concerned with an apparatus for filling the molds in such installations.

French printed patent application No. 2,144,520 discloses an installation for the continuous manufacture of slabs by molding a settable molding material, such as a concrete mix. The installation comprises a conveyor belt equipped with molds made of flexible material, the conveyor being adapted to advance the molds at right angles to a distributing station designed to meter the material accurately, the molds being advanced automatically without being subjected to harmful pressures.

With this in view the above identified French patent publication disclosed a distributing station comprising a loading hopper and a vibrating consolidating table, the loading hopper being associated with a vibrator adapted to impart essentially vertical vibrations thereto, whereas essentially horizontal vibrations are imparted to the table. The loading hopper is advantageously mounted on the vibrating table with a resilient suspension. The hopper is further provided, at its lower end, with an extension surrounding its discharge aperture; the extension has a flat lower surface parallel to the plane in which the molds are displaced, so that it covers an area larger than each of the molds. The lower surface is designed to cooperate with the top edge of each mold, so as to form a tight seal with the top edge.

The distributing station comprises a structure in which the loading is adapted to fill the molds with a metered quantity of molding material by direct contact with the upper edges thereof, and to keep the concrete mix in a suitable visco-plastic state, while the vibrating table imparts shearing forces to the molds, to assist discharge of the molding material from the hopper.

Now, it has been found in practice that an arrangement of this type does have disadvantages.

First, it has been found that complex means, chiefly in connection with the mounting of the hopper, are required. This is mainly due to the fact that the loading hopper has to vibrate vertically while at the same time forming a seal between its lower end and the edges of the mold.

Secondly, maintenance costs have been found to be considerable, and relatively frequent stoppages of the installation are required, with the consequent unreliable production rate affecting the cost of the finished product.

Finally, it has been found that the distribution of the molding material within the molds has not been uniform and has caused defects, so that molds which were not completely filled produced unusable slabs.

OBJECT AND SUMMARY OF THE INVENTION

An object of the invention is the provision of an apparatus in which the above drawbacks are overcome, which is reliable, has high production rates and produces products substantially free of defects, thereby reducing the cost of the finished product.

According to the invention there is provided apparatus for filling molds in motion carried by a conveyor belt. The conveyor belt has a path of movement running between a filling unit for filling the molds with molding material in the molds and a finishing unit. The filling unit comprises a vibrating table, a section of the conveyor belt at the filling unit bearing against the vibrating table to impart essentially vertical vibrations to the section of the conveyor and thereby to the mold in the section of the conveyor belt. A distributor member extends transversely to the conveyor belt and has a lower edge located slightly above a plane defined by the upper edges of the molds. The molding material is supplied immediately ahead or upstream of the distributor member relative to the direction of movement of the conveyor belt. The distributor member spreads the molding material in the mold at the filling unit by the relative displacement of the conveyor belt. Essentially horizontal vibrations are imparted to the distributor member parallel to the path of movement of the conveyor belt. The finishing unit comprises a smoothing member transversely displaceable relative to the path of movement of the conveyor belt, and means for reciprocating the smoothing member transversely of the path of movement of the conveyor belt.

One of the advantages of the apparatus is the fact that it comprises simple means which can be used without any particular difficulty.

Another advantage of such an apparatus is the fact that the vibrations imparted to the various members (table, distributor member and smoothing member) are in directions which effectively complement one another. The molding material delivered to the filling unit is therefore vibrated, which ensures that the molding material is well distributed within the molds—particularly in the corners—and secondly exerts stress which contributes towards improving the mechanical strength of the finished product, quite apart from its flawless appearance.

In addition to the advantages mentioned above, the present apparatus, bearing in mind the structure of each component unit, is particularly reliable; production rates can therefore be increased and maintenance costs correspondingly reduced.

Thus the problems with known installations have been resolved simply and effectively by the present apparatus.

These and other features and advantages of the invention will be brought out in the description which follows, given by way of an example with reference to the accompanying drawings.

DESCRIPTION OF THE PREFERRED EMBODIMENT

In the illustrated embodiment, the apparatus essentially comprises a filling unit and a finishing unit. The filling unit is generally indicated at 10, and the finishing unit at 11.

The molds 12, which are preferably made of flexible material, rubber, plastic or the like, are associated with an endless conveyor belt 13 which is driven by any appropriate means such as rolls (not shown) in the direction of the arrow F, so that the molds are first brought to the filling unit 10 then downstream to the finishing unit 11 relative to the direction of movement of the conveyor belt. Preferably, the molds are releasably mounted on the conveyor belt 13 by Velcro fasteners as disclosed in my copending patent application Ser. No. 06/346,092.

Figure 4:
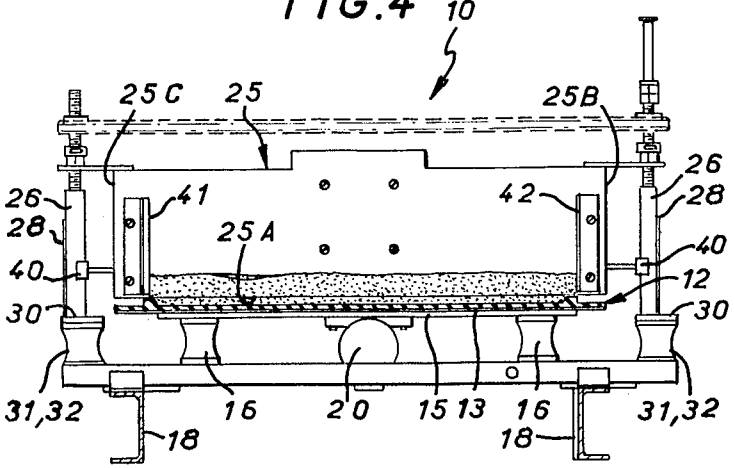
FIG. 4 is a sectional view taken along the line IV—IV in FIG. 3.
Figure 3:
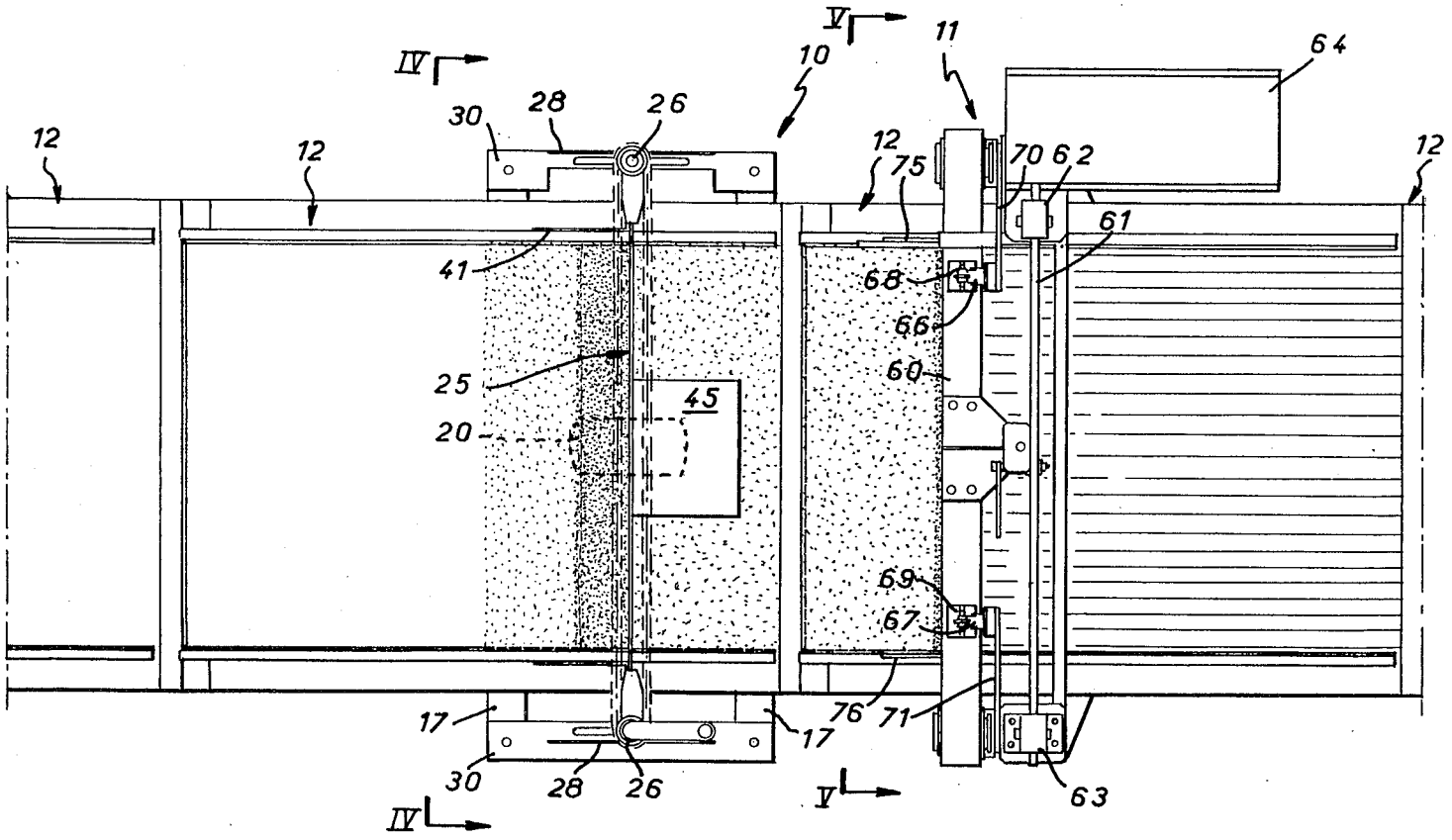
FIG. 3 is a plan view taken in the direction of the arrow III in FIG. 2.

The filling unit 10 comprises a table 15, which rests on cross pieces 17 with shock absorbers 16 interposed. The cross pieces 17 are in turn fixed to channel members 18 extending in the same direction as the conveyor belt 13, which is advantageously flexible. The upper surface of the table 15 forms a support for a section of the conveyor belt, and its lower surface is in contact with a vibrator 20 resting on a cross piece 21. As will be seen particularly in FIG. 4, the vibrator 20 is arranged substantially in a central region of the table, so that the conveyor belt receives vibrations along its center line; the vibrations transmitted by the vibrator are essentially vertical (arrows F1) or perpendicular to the plane of the conveyor belt.

Figure 2:
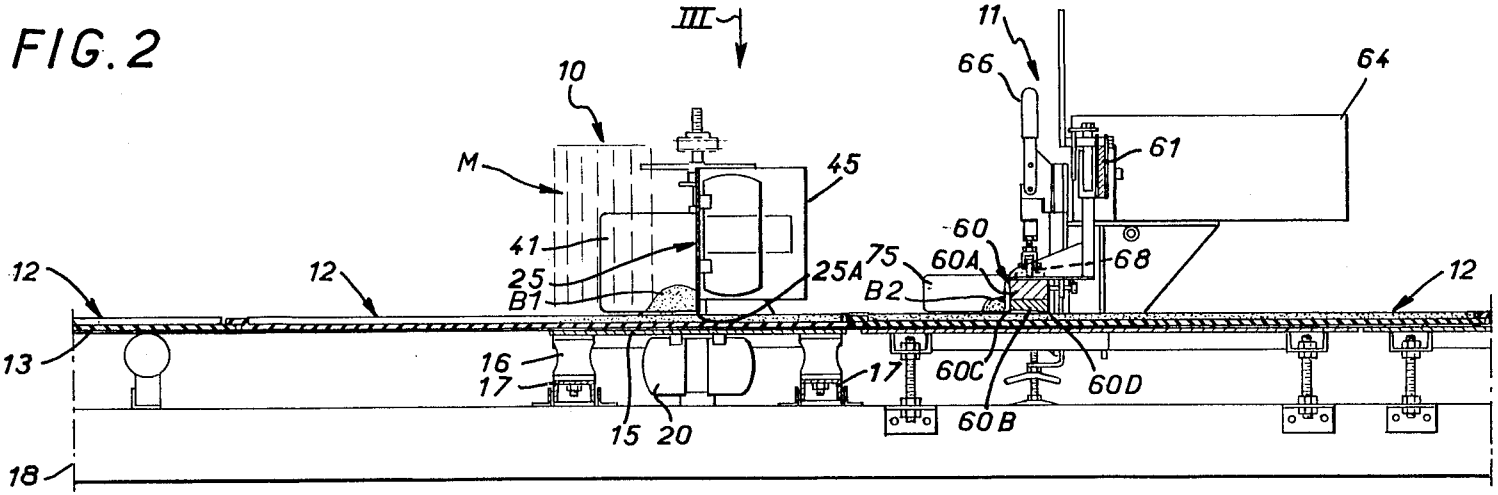
FIG. 2 is a sectional elevational view of the apparatus, taken along the line II—II in FIG. 1.
Figure 5:
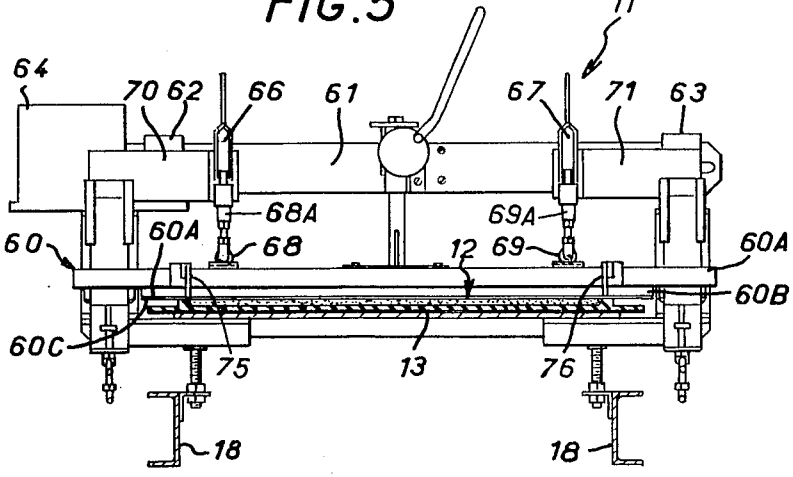
FIG. 5 is also a sectional view of the apparatus, taken in a plane passing through line V—V in FIG. 3.

The filling unit 10 in addition comprises a distributor member 25 in a generally vertical plane relative to the conveyor belt and therefore to the molds 12. The distributor member 25 has a lower edge 25A extending beyond the sides of the molds. The distributor member 25 is arranged transversely of the path of movement of the conveyor belt and the molds. The lower edge 25A of the distributor member 25 is not quite in contact with the upper edges of the molds 12 (FIG. 2), as will be seen later. However, the lower edge 25A is located substantially in the same vertical plane as the vibrator 20 associated with the table 15.

The vibrating distributor member 25 is fixed at each end for oscillating movement on a bracket 26. The supports 26 are fixed by brackets 28 on plates 30, which are themselves supported by the cross pieces 17 with shock absorbers 31, 32 interposed. The vibrating distributor member 25 is advantageously mounted so that it can be adjusted in height, by means (not shown) which may be provided on the brackets 26. At each end of the bar the sides 25B, 25C are attached to the brackets 26 by resiliently deformable arms 40.

The thus-described distributor member 25 therefore has a front surface upstream, facing towards the molds 12 before they are filled, and a back surface facing downstream, towards the filled molds. The front surface carries two lateral cheeks 41, 42, together with which it defines a zone in which the molds material M may be supplied as indicated in broken lines in FIG. 2, the zone being slightly upstream or ahead of the front surface. The molding material M is preferably supplied via a movable chute which is not shown here. As for the back surface of the distributor member 25, this carries a vibrator 45 in a central zone. The vibrator 45 is adapted to impart essentially horizontal vibrations thereto (arrow F2), in a direction parallel with the path of movement of the molds 12.

The finishing unit 11 essentially comprises a smoothing member, shown generally at 60, which is fixed in a central zone to a main control bar 61. The bar 61 is mounted for sliding movement in bearings 62, 63 and reciprocated by means of a motor 64 and a cam arrangement which is known per se and not shown.

Figure 1:
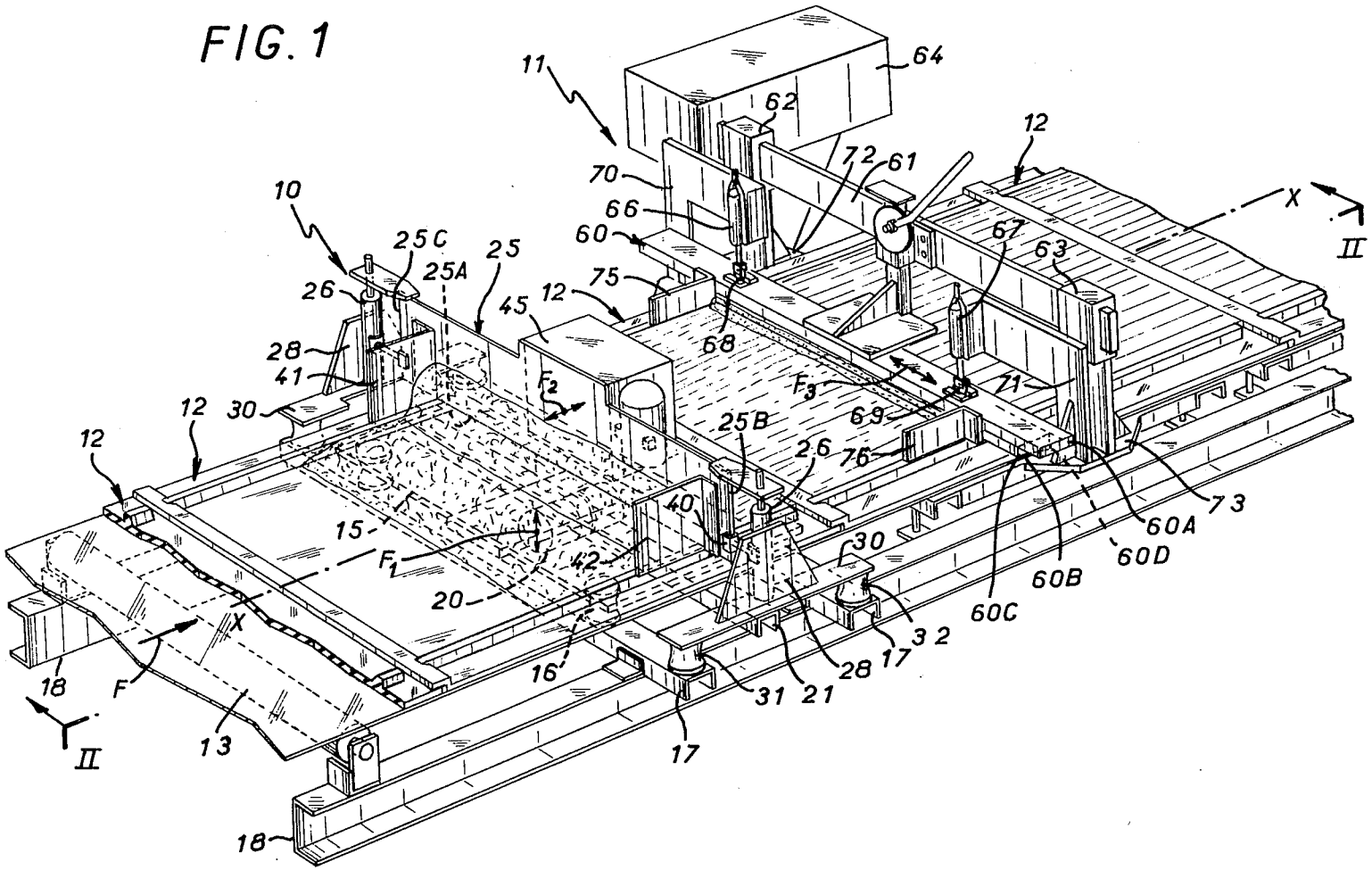
FIG. 1 is a diagrammatic perspective view of an apparatus embodying the invention.

The reciprocating movement of the smoothing member 60 is horizontal and transverse, in a direction which intersects or crosses the center line X—X of the endless belt (arrow F3 in FIG. 1).

As a means of avoiding any deformation of the smoothing member 60 in its longitudinal direction, the smoothing member cooperates with guides 66, 67 arranged on both sides of its central connection with the main control bar. The guides 66, 67 have rollers 68, 69 at the ends, mounted in ends of arms 68A, 69A. Arms 68A, 69A are in turn carried by supports 70, 71, fixed to plates 72, 73, which in addition support the bearings 62, 63.

The smoothing member 60 advantageously comprises (see particularly FIG. 2) a base 60A which is rigidly connected to the main control bar 61 and a blade 60B which is joined to the base in such a way that the blade 60B can easily be changed when it becomes worn. In order to ensure that the molding material is correctly smoothed and that no harmful stresses are applied to the top edges of the molds 12, the blade 60B is advantageously made of a non-stick material.

It will further be noted that the lower surface of the blade 60B has a transverse contact edge 60C oblique to the molds 12, higher than a rear edge 60D.

The smoothing member 60 also has lateral cheeks 75 and 76, fixed on its front edge facing the filling unit 10. The lower edges of the cheeks 75, 76 are adapted to provide a scraping action on the upper edges of the molds 12.

In operation, the conveyor belt 13 with molds 12 is driven along its path of movement at a speed V.

The supply of molding material is adjusted so that a mound B1 of material is formed at the filling unit 10; the amount of material in the mound is determined to substantially fill one mold 12. While the mold 12 is in motion, vibrations are constantly applied to the mound B1 by vibrating table 15 (essentially vertical vibrations tending to exert a consolidating action) and the reciprocating movements are applied to the mound B1 by vibrating distributor member 25, horizontal movements of the distributor member ensuring the correct filling of the molds). Thus the combined operations of the vibrating table 15 and the distributor member 25 ensure that the molds are properly filled. The movements are possible since the lower edge 25A of the vibrating distributor member is a slight distance above the upper edges of the mold.

When the molds have passed the filling unit 10, they are filled with a slight excess amount of material due to the vertical vibrations that forms a free surface with slight waves.

Now the finishing unit 11 comes into action. The finishing unit 11 is adapted to remove the excess material by the combined action of the cheeks 70, 71 and the reciprocating movements of the smoothing member 60. A mound B2 of excess material is formed at the finishing unit 11 and may be recycled by a worker monitoring the installation or, if appropriate, may fill any depressions which may have formed at the filling unit.

It will be noted that the smoothing member 60 is reciprocated transversely and horizontally, intersecting the path of movement of the molds 12. Since the blade has an oblique lower surface, its rear edge 60D has a shearing effect, whereby the excess material is sheared off as the molds 12 gradually advance. Now the structure of the molding material is changed by incipient setting between the filling unit 10 and the finishing unit 11, and the smoothing member 60 thus removes the peaks effectively and accurately, since it acts on the surface without reaching lower layers.

It will be seen that the arrangement according to the invention enables mold to be filled correctly and continuously by ensuring a slight excess of any molding material even molding materials which are difficult to handle, such as settable molding materials.

The invention is not of course restricted to the described and illustraged embodiment but admits of various modifications and alternatives without departing from the scope of the invention.

What I claim is:

1. An apparatus for filling molds in motion carried by a conveyor belt, said conveyor belt having a path of movement running between a filling unit for filling said molds with molding material and a finishing unit for smoothing the top surface of the molding material in said molds, said filling unit comprising a vibrating table, a section of said conveyor belt at said filling unit bearing against said vibrating table to impart essentially vertical vibrations to said section of said conveyor belt and thereby to said mold in said section of said conveyor belt, a distributor member extending transversely of said conveyor belt, said distributor member having a lower edge located slightly above a plane defined by the free upper edges of said molds, means for supplying molding material being disposed immediately ahead of the distributor member relative to the direction of movement of said conveyor belt, said distributor member spreading molding material in said mold at said filling unit by the relative displacement of said conveyor belt, means imparting essentially horizontal vibrations to said distributor member, parallel to the path of movement of said conveyor belt, said finishing unit comprising a smoothing member, and means imparting essentially horizontal vibrations to said smoothing member, said smoothing member being displaceable transversely of the path of movement of said conveyor belt, and means for reciprocating said smoothing member transversely of the path of movement of said conveyor belt in a manner wherein said smoothing member eliminates surface irregularities in the top surface of the molding material produced by vertical vibrations imparted by said distributor member.

2. The apparatus of claim 1, wherein said distributor member lies generally in a vertical plane with its ends extending beyond the longitudinal sides of said molds, said distributor member having a lower edge spaced a distance above said longitudinal sides of said mold corresponding to the amplitude of vibrations imparted by said vibrating table.

3. The apparatus of claim 1, wherein a bracket supporting said distributor member is provided at each end thereof, resilient deformable members are interposed between said distributor member and said brackets, said bracket each being attached to a plate mounted on shock absorbing means.

4. The apparatus of claim 1, wherein said distributor member has a front surface facing upstream and a back surface facing downstream relative to the direction movement of said conveyor belt, lateral cheeks being provided on said front surface and vibrator means carried at the middle of said back surface of said distributor member.

5. The apparatus of claim 1, wherein said vibrating table comprises vibrator means arranged at its center, said vibrator means being substantially in vertical alignment with said distributor member.

6. The apparatus of claim 1, wherein said smoothing member is fixed to a main bar, said main bar being mounted for sliding movement in bearings and connected by one end to said means for reciprocating said smoothing member.

7. The apparatus of claim 6, wherein said smoothing member comprises a blade and central fastening means fixing said blade to said main bar in a central zone.

8. The apparatus of claim 7, wherein means for guiding said smoothing member are provided on both sides of said central fastening means.

9. The apparatus of claim 1, wherein said smoothing member comprises a blade having a lower surface disposed in an oblique plane with a forward edge higher than a rear edge, said rear edge being in contact with top edges of said molds.

10. The apparatus of claim 7, wherein said smoothing member comprises a base rigidly connected to said central fastening means, and a blade defining said oblique plane, said blade being detachably mounted on said base.

11. The apparatus of claim 1, wherein said smoothing member is provided with lateral cheeks.

12. The apparatus of claim 1, wherein said essentially vertical vibrations produced by said vibrating table, said means imparting essentially horizontal vibrations to said distributor member, and said means imparting essentially horizontal vibrations to said smoothing member are respectively substantially mutually perpendicular to one another.

13. The apparatus of claim 1, wherein said smoothing member forms means for removing excess material from said mold in said finishing unit for recycling in the molding apparatus.

14. An apparatus for filling molds in motion carried by a conveyor belt, said conveyor belt having a path of movement running between a filling unit for filling said molds with molding material and a finishing unit for smoothing the top surface of the molding in said molds; said filling unit comprising a vibrating table, a section of said conveyor belt at said filling unit bearing against said vibrating table to impart essentially vertical vibrations to said section of said conveyor belt and thereby to that one of said molds in said section of said conveyor belt for consolidating molding material in said one mold; a distributor member extending transversely of said conveyor belt, said distributor member having a lower edge located slightly above a plane defined by the free upper edges of said molds, means for supplying molding material being disposed immediately upstream of the distributor member relative to the direction of movement of said conveyor belt, said distributor member spreading molding material in said mold at said filling unit by the relative displacement of said conveyor belt, means imparting essentially horizontal vibrations to said distributor member, parallel to the path of movement of said conveyor belt, the vibrations produced by said vibrating table and said distributor member ensuring the correct filling of the said mold at the filling unit, said finishing unit comprising a smoothing member, and means imparting essentially horizontal vibrations to said smoothing member, said smoothing member being displaceable transversely of the path of movement of said conveyor belt, and means for reciprocating said smoothing member transversely of the path of movement of said conveyor belt.

* * * * *